United States Patent [19]

Horodysky et al.

[11] Patent Number: 4,492,640

[45] Date of Patent: Jan. 8, 1985

[54] TRIHYDROXYHYDROCARBYL SULFIDES AND LUBRICANTS CONTAINING SAME

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 463,223

[22] Filed: Feb. 2, 1983

[51] Int. Cl.[3] ..... C10M 1/54

[52] U.S. Cl. ..... 252/46.3; 252/49.6; 252/46.6; 252/32.7 E

[58] Field of Search ..... 252/46.3, 49.6, 46.6, 252/32.7 E

[56] References Cited

U.S. PATENT DOCUMENTS

| | | | |
|---|---|---|---|
| 4,031,023 | 6/1977 | Musser et al. | 252/48.2 |
| 4,250,046 | 2/1981 | Przybylinski | 252/49.3 |
| 4,384,967 | 5/1983 | Salentine et al. | 252/49.6 |
| 4,394,277 | 7/1983 | Small, Jr. | 252/32.7 E |

*Primary Examiner*—Jacqueline V. Howard

*Attorney, Agent, or Firm*—Alexander J. McKillop; Michael G. Gilman; Claude E. Setliff

[57] ABSTRACT

The invention provides a compound effective as a friction reducer in lubricants and fuels, thus reducing the consumption of fuel. The compound is a boron derivative of a mixture of alkoxylated alcohols and hydroxysulfides.

25 Claims, No Drawings

TRIHYDROXYHYDROCARBYL SULFIDES AND LUBRICANTS CONTAINING SAME

BACKGROUND OF THE INVENTION

1. Field of the Invention

The invention relates to lubricant and liquid fuel additives and to compositions containing same. In particular, it relates to borated mixtures of long chain alcohols and trihydroxyhydrocarbyl sulfides and to their use in lubricants and liquid fuels to reduce friction and fuel consumption in internal combustion engines.

2. Discussion of the Related Art

It is known that sliding or rubbing metals or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggests them, or their use in lubricants or fuels. There are, however, patents that disclose certain sulfur-containing materials. They include, for example, U.S. Pat. No. 3,361,723 which discloses a thiol-containing polyether and a process for its preparation and U.S. Pat. No. 4,244,827 teaches mixtures of di- or trithiophosphate acid diesters produced from 1,2-diols or 1-mercapto-2-hydroxy compounds and $P_2S_5$.

SUMMARY OF THE INVENTION

In accordance with the invention there is provided a lubricant or liquid fuel composition comprising a major amount of a lubricant or fuel and a friction reducing amount of a product made by reacting (1) a mixture of a long chain alcohol or an alkoxylated alcohol of the formula:

$$R(OR^1)_xOH$$

wherein R is a hydrocarbyl group containing 8 to 30 carbon atoms. $R^1$ is a $C_2$ to $C_4$ alkylene group and x is 0 to 10 and a compound of the formula:

$$(HO)_yR^2SR^3(OH)_z$$

wherein $R^2$ is a $C_6$ to $C_{30}$ hydrocarbyl group and $R_3$ is a $C_2$ to $C_6$ alkyl group, the total of carbon atoms from $R^2$ and $R^3$ being from 8 to 36, and either of y and z is 0 to 3, the sum thereof being at least 3 with (2) boric acid or another active boron compound. It will be understood that all of the OH groups can be attached to $R^2$ or to $R^3$, or they can be attached to both $R^2$ and $R^3$ and that they can be attached to any carbons in these groups. It is not necessary, for example, that they be on adjacent carbon atoms, but preferably 2 of the OH groups are on adjacent carbons. The invention also provides the reaction product.

DESCRIPTION OF SPECIFIC EMBODIMENTS

The sulfides can be made by any process known to the art. For example, they can be made by reacting a mercaptoglycerol, a phase transfer catalytst, e.g. $(C_8-C_{10})_3N^+CH_3Cl^-$, used to enhance the solubility of the mercaptide in situ, sodium hydroxide or other alkali metal hydroxide and a hydrocarbyl epoxide, e.g., a $C_{15}-C_{18}$ epoxy alkane. In this reaction the mercaptide is allowed to form first, followed by addition of the epoxide. The product obtained may be the following

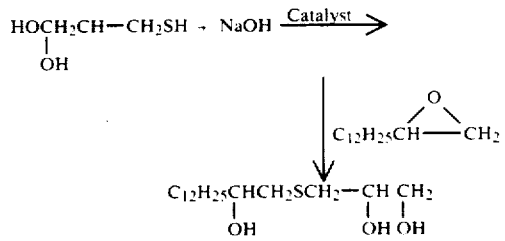

Other epoxyalkanes that may be used in the reaction are those containing from 7 to 18 carbon atoms, including 1,2-epoxydecane, 1,2-epoxydodecane, 1,2-epoxytetradecane, 1,2-epoxypentadecane, 1,2-epoxyhexadecane and 1,2-epoxyoctadecane.

Any reactive boron compound can be used in the reaction. Included among the useful members are boric acid, metaboric acid, trialkyl borates, such as trimethyl, triethyl and tributyl borates, alkyl metaborates and the alkyl borines and boroxides. Preferred are those of the formula $$(R^4O)_aB(OH)_b$$

wherein $R^4$ is a $C_1$ to $C_6$ alkyl group and a and b are 0 to 3, their sum being 3.

In the long chain alcohols defined hereinabove, "alkylene" includes ethylene, propylene and butylene. "Hydrocarbyl" is preferably an alkyl group, including octyl, nonyl, decyl, dodecyl, tetreadecyl, octadecyl and the like, as well as maixtures thereof. The latter term can also be aryl of 6 to 14 carbon atoms.

The alkoxylated alcohols useful in this invention are readily available commercially. Where specific members are not available, they may be made by the catalyzed reaction of the appropriate alcohol with an epoxide, such as ethylene oxide, propylene oxide and the like. Among the alkoxylated alcohols contemplated are alkoxylated nonanol, decanol, dodecanol, tetradecanol, pentadecanol and oleyl alcohol, as well as mixtures of these alcohols, such as mixtures of $C_9$ to $C_{11}$ alcohols or $C_{12}$ to $C_{15}$ alcohols.

Reaction of the mixture of alcohol and hydroxysulfide in proportions ranging in respective molar ratios of from about 4:1 to about 1:4, preferably about 2:1 to about 1:2, with, for example, boric acid or a trialkyl borate or other boronating agent, can be carried out at temperatures of from about 90° C. to about 260° C. in, if desired, an alcohol such as butanol or pentanol, a hydrocarbon solvent such as benzene, toluene or xylene, or mixtures thereof. The preferred temperature is about 110° C. to about 200° C.

As is true of the temperatures, reaction times are not critical, and can range from 1 hour or less to 24 hours or more.

Reaction of the boron compound with the alcohol-hydroxysulfide mixture will preferably employ up to a stoichiometric amount of such boron compound. The boron compound may, however, be in excess of the amount required for complete reaction. Thus, a product may be made to produce a derivative containing from about 0.1% to about 10% by weight of boron. At least 5% to 10% of the available hydroxyl groups should be borated to derive substantial beneficial results. Conversely, a stoichiometric excess of boric acid (more than an equivalent amount of boronating agent compared to available hydroxyl groups) can also be charged to the reaction medium, resulting in a product containing the stated amount of boron. The compounds can also be borated with a trialkyl borate such as tributyl borate, often in the presence of boric acid. Preferred reaction temperatures for boration with the borate will range from about 180° C. to about 280° C. Times can be from about 2 to about 12 hours, or more, whether the mixture is borated or each is borated and then mixed.

The sulfides are used with lubricating oils to the extent of from about 0.1% to about 10% by weight of the total composition. Furthermore, other additives, such as detergents, anti-oxidants, anti-wear agents and the like may be present. These can include phenates, sulfonates, succinimides, zinc dithiophosphates, polymers, including methacrylates and olefin copolymers, calcium and magnesium salts and the like.

The lubricants contemplated for use with the esters herein disclosed include mineral and synthetic hydrocarbon oils of lubricating viscosity, mixtures of mineral oils and synthetic oils and greases from any of these, including mixtures. The synthetic hydrocarbon oils include long-chain alkanes such as cetanes and olefin polymers such as oligomers of hexane, octene, decene, and dodecene, etc. The compounds of the invention are especially effective in synthetic oils formulated using mixtures of synthetic hydrocarbon olefin oligomers and lesser amounts of hydrocarbyl carboxylate ester fluids. The other synthetic oils, which can be used alone with the borated compounds of this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms trimethylolpropane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty materials having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyanines, indanthrene, pigments such as perylimides, pyromellitdiimides, and ammeline.

The preferred thickening gelling agents employed in the grease compositions are essentially hydrophobic clays. Such thickening agents can be prepared from clays which are initially hydrophilic in character, but which have been converted into a hydro-phobic condition by the introduction of long chain hydrocarbon radicals into the surface of the clay particles; prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention. More specifically, the clays which are useful as starting materials in forming the thickening agents to be employed in the grease compositions, can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates, and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays, and the like. The thickening agent is employed in an amount from about 0.5 to about 30, and preferably from 3 percent to 15, percent by weight of the total grease composition.

The liquid fuels contemplated include liquid hydrocarbon fuels such as fuel oils, diesel oils and gasolines and alcohol fuels such as methanol and ethanol or mixtures of these fuels. They may be used in concentration of from about 10 pounds to about 500 pounds per 1000 barrels of fuel, preferably from about 15 pounds to about 100 pounds per 1000 barrels.

Having described the invention in general terms, the following are offered to specifically illustrate the development. It is to be understood they are illustrations only and that the invention shall not be limited except as limited by the appended claims.

EXAMPLE 1

Synthesis of 1-(β-hydroxy)pentadecyl-octadecyl sulfide-2,3-dihydroxy propane A mixture of 90% 1-mercaptoglycerol (56.7 g), methyl tri($C_8$–$C_{10}$) alkyl ammonium chloride (10.9 g), 50% sodium hydroxide (38 g), toluene (40 cc) and water (20 cc) were stirred at room temperature. The reaction temperature rose to 69° C. 1,2-Mixed-$C_{15}$–$C_{18}$ alkyl epoxide (114.7 g) were added dropwise over a period of 2½ hours. The vigorously agitated reaction mixture thickened appreciably upon addition of epoxide, and an additional 300 cc of toluene and 100 cc of water were added. The reaction was refluxed for one hour and transferred hot to a 2-liter separatory funnel After sitting overnight the water layer separated easily from the toluene layer with heating. The acidified washed contained no 1-mercaptoglycerol. The toluene solution was washed with water (2×100 cc) and dried over $MgSO_4$-$Na_2SO_4$. The solution was filtered and the solvent was removed by high speed rotary evaporation to yield a tan waxy solid.

EXAMPLE 2

Synthesis of mixed $C_{12}$–$C_{15}$ linear alcohols and 1-(β-hydroxy)pentadecyl-octadecyl sulfide-2,3-dihydroxy propane borate A mixture of $C_{12}$ to $C_{15}$ linear alcohols (20.9 g) and 1-(β-hydroxy)pentadecyl-octadecyl sulfide-2,3-dihydroxy propane (35.2 g), prepared as described in Example 1, were dissolved in a solvent system comprising 20 g of n-butanol and 60 g of toluene at 60° C. Boric acid (8.3 g) was added, and the reaction temperature was increased reflux. The expected amount of water was removed via azeotropic distillation. The reaction solution was cooled to room temperature and filtered through diatomaceous earth. Solvents were removed by high speed rotary evaporation yielding an off-white, waxy solid product.

EXAMPLE 3

Synthesis of 1-(β-hydroxy)tetradecyl sulfide-2,3-dihydroxypropane

A mixture of 90% 1-mercaptoglycerol (113.4 g), methyl tri($C_8$–$C_{10}$)alkyl ammonium chloride (21.8 g), 50% sodium hydroxide (76 g), toluene (80 cc), and water (40 cc) were stirred at room temperature. The reaction temperature rose to 75° C. 1,2-Tetradecyl epoxide (200 g) was added dropwise over a period of 1 hour, and the reaction temperature remained between 75° C. and 78° C. during addition. The reaction mixture became very viscous after the addition, and an additional 60 cc toluene and 60 cc water were added. The reaction mixture was refluxed at 92° C. for 1 hour and transferred hot to a separatory funnel. Approximately 400 cc toluene and 200 cc water were added. After the water wash, the toluene solution was filtered through diatomaceous earth. Solvent was removed by high speed rotary evaporation to yield a tan waxy solid.

EXAMPLE 4

Synthesis of mixed $C_{12}$–$C_{15}$ linear alcohols and 1-(β-hydroxy)tetradecyl sulfide-2,3-dihydroxypropane borate A mixture of $C_{12}$ to $C_{15}$ linear alcohols (37.6 g) and 1-(β-hydroxy)tetradecyl sulfide-2,3-dihydroxypropane (60 g), prepared as described in Example 3, were dissolved in 20 g of n-butanol and 60 g of toluene at 45° C. Boric acid (14.9 g) were added, and the reaction temperature was increased to 90° C. Water was removed between 90° C. and 107° C. via azeotropic distillation. The reaction solution was cooled to room temperature and filtered through diatomaceous earth. Solvents were removed by high speed rotary evaporation to yield an off-white waxy solid product.

EXAMPLE 5

Synthesis of mixed $C_{12}$–$C_{15}$ linear triethoxylated alcohols and 1-(β-hydroxy)tetradecyl sulfide-2,3-dihydroxypropane borate A mixture of $C_{12}$ to $C_{15}$ linear triethoxylated alcohols (60.7 g) and 1-(β-hydroxy)tetradecyl sulfide-2,3-dihydroxypropane (60 g), prepared as described in Example 3, were dissolved in 20 g of n-butanol and 60 g of toluene at 60° C. Boric acid (14.9 g) was added, and the reaction temperature was increased to 95° to 120° C. Water was removed via azeotropic distillation. The reaction solution was cooled to room temperature and filtered through diatomaceous earth. Solvents were removed by high speed rotary evaporation to yield a white waxy solid product.

EVALUATION OF PRODUCTS

The compounds were evaluated as friction modifiers in accordance with the following test.

LOW VELOCITY FRICTION APPARATUS

Description

The Low Velocity Friction Apparatus (LVFA) is used to measure the friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam motor arrangement.

Procedure

The rubbing surfaces and 12–13 ml of test lubricant are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 240 psi and 40 fpm sliding speed. Afterward, measurements of $U_k$ vs. speed are taken at 240, 300, 400, and 500 psi. Freshly polished steel specimens are used for each run. The surface of the steel is parallel ground to 4–8 microinches.

The data obtained are shown in Table 1. The data in Table 1 are reported as percent reduction in coefficient of friction at two speeds. The fully formulated 5W-30 synthetic lubricating oil had the following general characteristics:

| | |
|---|---|
| Viscosity at 100° C. | 10.6 Cs |
| Viscosity at 40° C. | 57.7 Cs |
| Viscosity Index | 172 |

TABLE 1

| | Friction Characteristics | | |
|---|---|---|---|
| | Additive Conc. | Reduction or % Change in Coefficient of Friction | |
| Additive | Wt. % | 5 Ft./Min. | 30 Ft./Min. |
| Base Oil (fully formulated engine oil) | 0 | 0 | 0 |
| Example 2 | 1 | 40 | 32 |
| Example 4 | 0.5 | 33 | 32 |
| Example 5 | 0.5 | 25 | 16 |

We claim:

1. A product made by reacting (1) a mixture of an alcohol of the formula $$R(OR^1)_xOH$$

wherein R is a hydrocarbyl group containing 8 to 30 carbon atoms, $R^1$ is a $C_2$ to $C_4$ alkylene group and x is 0 to 10 and a hydroxysulfide of the formula $$(HO)_yR^2SR^3(OH)_z$$

wherein $R^2$ is a $C_6$ to $C_{30}$ hydrocarbyl group, $R^3$ is a $C_2$ to $C_6$ alkyl group, the sum of the carbon atoms of $R^2$ and $R^3$ being 8 to 36, y and z are 0 to 3, their sum being 3 with (2) a boron compound, the reaction being carried out at from about 90° C. to about 260° C. using the alcohol-hydroxysulfide mixture in a respective molar ratio of from about 4:1 to about 1:4 and sufficient boron compound to provide from about 0.1% to about 10% by weight of boron in said product.

2. The product of claim 1 wherein the boron compound is boric oxide or of the formula $$(R^4O)_aB(OH)_b$$

wherein $R^4$ is a $C_1$ to $C_6$ alkyl group, and a and b are 0 to 3, their sum being 3.

3. The product of claim 2 wherein the boron compound is boric acid.

4. The product of claim 1 wherein the hydrocarbyl group is an alkyl group.

5. The product of claim 1 wherein the mixture is of 1-(β-hydroxy) pentadecyl-octadecyl sulfide-2,3-dihydroxypropane and mixed $C_{12}$–$C_{15}$ linear alcohols and the boron compound is boric acid.

6. The product of claim 1 wherein the mixture is of 1-(β-hydroxy) tetradecyl sulfide-2,3-dihydroxypropane and mixed $C_{12}$–$C_{15}$ linear alcohols and the boron compound is boric acid.

7. The product of claim 1 wherein the mixture is of 1-(β-hydroxy) tetradecyl sulfide-2,3-dihydroxypropane and mixed $C_{12}$–$C_{15}$ linear triethoxylated alcohols and the boron compound is boric acid.

8. A lubricant composition comprising a major proportion of a lubricating oil or a grease therefrom and a friction reducing amount of a product made by reacting (1) a mixture of an alcohol of the formula $$R(OR^1)_xOH$$

wherein R is a hydrocarbyl group containing 8 to 30 carbon atoms, $R^1$ is a $C_2$ to $C_4$ alkylene group and x is 0 to 10 and a hydroxysulfide of the formula $$(HO)_yR^2SR^3(OH)_z$$

wherein $R^2$ is a $C_6$ to $C_{30}$ hydrocarbyl group, $R^3$ is a $C_2$ to $C_6$ alkyl group, the sum of the carbon atoms of $R^2$ and $R^3$ being 8 to 36, y and z are 0 to 3, their sum being 3 with (2) a boron compound, the reaction being carried out at from about 90° C. to about 260° C. using the alcohol-hydroxysulfide mixture in a respective molar ratio of from about 4:1 to about 1:4 and sufficient boron compound to provide from about 0.1% to about 10% by weight of boron in said product.

9. The composition of claim 8 wherein the boron compound is boric oxide or of the formula $$(R^4O)_aB(OH)_b$$

wherein $R^4$ is a $C_1$ to $C_6$ alkyl group, and a and b are 0 to 3, their sum being 3.

10. The composition of claim 9 wherein the boron compound is boric acid.

11. The composition of claim 8 wherein the hydrocarbyl group is an alkyl group.

12. The composition of claim 8 wherein the mixture is of 1-(β-hydroxy) pentadecyl-octadecyl sulfide-2,3-dihydroxypropane and mixed $C_{12}$–$C_{15}$ linear alcohols and the boron compound is boric acid.

13. The composition of claim 8 wherein the mixture is of 1-(β-hydroxy) tetradecyl sulfide-2,3-dihydroxypropane and mixed $C_{12}$–$C_{15}$ linear alcohols and the boron compound is boric acid.

14. The composition of claim 8 wherein the mixture is of 1-(β-hydroxy) tetradecyl sulfide-2,3-dihydroxypropane and mixed $C_{12}$–$C_{15}$ linear triethoxylated alcohols and the boron compound is boric acid.

15. The composition of claim 8 wherein the lubricant is (1) a mineral lubricating oil, (2) a synthetic lubricating oil or a mixture of synthetic lubricating oils, (3) a mixture of (1) and (2) or (4) a grease from any of (1), (2), and (3).

16. The composition of claim 15 wherein the lubricant is a synthetic lubricating oil or a mixture of synthetic lubricating oils.

17. A method of reducing fuel consumption in an internal combustion by lubricating said engine with a lubricant composition comprising a major proportion of a lubricant and a friction reducing amount of a product made by reacting (1) a mixture of an alcohol of the formula $$R(OR^1)_xOH$$

wherein R is a hydrocarbyl group containing 8 to 30 carbon atoms, $R^1$ is a $C_2$ to $C_4$ alkylene group and x is 0 to 10 and a hydroxysulfide of the formula $$(HO)_yR^2SR^3(OH)_z$$

wherein $R^2$ is a $C_6$ to $C_{30}$ hydrocarbyl group, $R^3$ is a $C_2$ to $C_6$ alkyl group, the sum of the carbon atoms of $R^2$ and $R^3$ being 8 to 36, y and z are 0 to 3, their sum being 3 with (2) a boron compound, the reaction being carried out at from about 90° C. to about 260° C. using the alcohol-hydroxysulfide mixture in a respective molar ratio of from about 4:1 to about 1:4 and sufficient boron compound to provide from about 0.1% to about 10% by weight of boron in said product.

18. The method of claim 17 wherein the lubricant is a synthetic lubricating oil.

19. The method of claim 18 wherein in the product the mixture is of 1-(β-hydroxy) pentadecyl-octadecyl sulfide-2,3-dihydroxypropane and mixed $C_{12}$–$C_{15}$ linear alcohols and the boron compound is boric acid.

20. The method of claim 18 wherein the product the mixture is of 1-(β-hydroxy) tetradecyl sulfide-2,3-dihydroxypropane and mixed $C_{12}$–$C_{15}$ linear alcohols and the boron compound is boric acid.

21. The method of claim 18 wherein the product the mixture is of 1-(β-hydroxy) tetradecyl sulfide-2,3-dihydroxypropane and mixed $C_{12}$–$C_{15}$ linear triethoxylated alcohols and the boron compound is boric acid.

22. The composition of claim 8 having therein other additives comprising a zinc dithiophosphate.

23. The composition of claim 15 wherein the lubricant is a mineral lubricating oil.

24. The composition of claim 15 wherein the lubricant is the lubricating oil of (3).

25. The composition of claim 15 wherein the lubricant is the grease of (4).

* * * * *